US006563469B2

(12) United States Patent
Miyata et al.

(10) Patent No.: US 6,563,469 B2
(45) Date of Patent: May 13, 2003

(54) FOUR-POINT LOOP ANTENNA INTO WHICH A MATCHING CIRCUIT IS INTEGRATED

(75) Inventors: Masaaki Miyata, Atsugi (JP); Akira Miyoshi, Chofu (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/032,935

(22) Filed: Dec. 27, 2001

(65) Prior Publication Data

US 2003/0063040 A1 Apr. 3, 2003

(30) Foreign Application Priority Data

Sep. 28, 2001 (JP) ..... 2001-300099

(51) Int. Cl.[7] ..... H01Q 11/12; H01Q 1/50

(52) U.S. Cl. ..... 343/743; 343/700 MS; 343/857; 343/895

(58) Field of Search ..... 343/741, 742, 343/743, 744, 866, 867, 895, 853, 700 MS, 850, 857, 858

(56) References Cited

U.S. PATENT DOCUMENTS 5,134,422 A * 7/1992 Auriol ..... 343/895
5,986,616 A * 11/1999 Edvardsson ..... 343/853
6,075,501 A * 6/2000 Kuramoto et al. ..... 343/895

* cited by examiner

*Primary Examiner*—Hoang Nguyen
(74) *Attorney, Agent, or Firm*—Frishauf, Holtz, Goodman & Chick, P.C.

(57) ABSTRACT

In order to feed at four points to a loop portion (12) made of conductor formed around a central axis (O) in a loop fashion along a peripheral surface of a cylindrical body (11) formed by rounding a flexible insulator film member (20) around the central axis in a cylindrical fashion, each of four feeders (13) formed on the peripheral surface of the cylindrical body comprises a vertical feeding portion (131) having one end (131*a*) grounded and another end (131*b*) extending toward the loop portion, a zigzag line (132) disposed between the other end of the vertical feeding portion and the loop portion, a tap (133) for feeding from a feeding terminal (13*a*) to the vertical feeding portion.

2 Claims, 3 Drawing Sheets

FOUR-POINT LOOP ANTENNA INTO WHICH A MATCHING CIRCUIT IS INTEGRATED

BACKGROUND OF THE INVENTION

This invention relates to a digital radio receiver for receiving an electric wave from an artificial satellite (that may be called a "satellite wave") or an electric wave on the ground (that may be called a "ground wave") to listen in a digital radio broadcasting and, in particular, to a loop antenna for use in the digital radio receiver.

In recent years, a digital radio receiver, which receives the satellite wave or the ground wave to listen in the digital radio broadcasting, has been developed and is put to practical use in the United States of America. The digital radio receiver is mounted on a mobile station such as an automobile and can receive an electric wave having a frequency of about 2.338 gigahelts (GHz) to listen in a radio broadcasting. That is, the digital radio receiver is a radio receiver which can listen in a mobile broadcasting. In addition, the ground wave is an electric wave in which a signal where the satellite wave is received in an earth station is frequently shifted a little.

In order to receive such an electric wave having the frequency of about 2.338 GHz, it is necessary to set up an antenna outside the automobile. Although a variety of antennas having various structures have been proposed, the antennas of cylindrical-type are generally used rather than those of planer-type (plane-type). This is because a wider directivity is achieved by forming the antenna into a cylindrical shape.

A loop antenna is known in the art as one of the antennas of the cylindrical-type. The loop antenna has structure where one antenna lead member is wound around a peripheral surface of a hollow or solid cylindrical (which is collectively called "cylindrical") member in a loop fashion, namely, is an antenna having the form of a loop. The cylindrical member may be merely called a "bobbin" or a "dielectric core" in the art. In addition, the antenna lead member may be merely called a "lead." It is known in the art that the loop antenna acts as an antenna having a directivity in a longitudinal direction thereof if the antenna lead member has an all around length which is selected to about one wavelength. This is because the antenna lead member has a sinusoidal distribution of a current.

Although it is necessary for the loop antenna to feed to it, a four-point feeding is generally adopted to the loop antenna. In order to receive circular polarization, feeding is carried out at four points having a phase difference of 90 degrees from one another. The loop antenna with the four-point feeding is called in the art a four-point feeding loop antenna. In a conventional four-point feeding loop antenna, a feeding is directly carried out to a loop portion.

More specifically, the conventional four-point loop antenna comprises a cylindrical body formed by rounding a flexible insulation film around a central axis in a cylindrical fashion, a loop portion made of conductor that is formed on the cylindrical body along a peripheral surface thereof around the central axis in a loop fashion, and four feeders formed on the peripheral surface of the cylindrical body to feed the loop portion at four points. In addition, each of the four feeders consists of a vertical feeding portion and the loop portion is directly connected with each of the four feeders.

After the electric wave is received by the loop portion as a received wave, the received wave is divided through the four feeders into four partial received waves which are phase shifted and combined by a phase shifter so as to match phases of the four partial received waves to obtain a combined wave, and then the combined wave is amplified by a low-noise amplifier (LNA) to obtain an amplified wave which is delivered to a receiver body. A combination of the four-point feeding loop antenna, the phase shifter, and the low-noise amplifier is called an antenna unit.

In the manner which is described above, inasmuch as the conventional four-point feeding loop antenna comprises the four feeders each consisting of the vertical feeding portion and directly feeds to the loop portion from the four feeders, the conventional four-point feeding loop antenna is disadvantageous in that it has a too high feeding impedance. Thus, the conventional four-point feeding loop antenna is disadvantageous in that a special matching circuit for obtaining an impedance match is required aside from the four-point loop antenna.

SUMMARY OF THE INVENTION

It is therefore an object of the present invention to provide a four-point feeding loop antenna into which a matching circuit is integrated.

Other objects of this invention will become clear as the description proceeds.

According to an aspect of this invention, a four-point feeding loop antenna comprises a cylindrical body formed by rounding a flexible insulator film member around a central axis in a cylindrical fashion. The cylindrical body has a peripheral surface. Made of conductor, a loop portion is formed on the cylindrical body along the peripheral surface around the central axis in a loop fashion. In order to feed to the loop portion at four points, four feeders are formed on the peripheral surface of the cylindrical body. Each of the four feeders comprises a vertical feeding portion having one end grounded and another end extending toward the loop portion, a zigzag line disposed between the other end of the vertical feeding portion and the loop portion, a tap for feeding from a feeding terminal to the vertical feeding portion.

In the above-mentioned four-point feeding loop antenna, the flexible insulator film member may substantially have a rectangular shape having an upper side, a lower side, a first lateral side, and a second lateral side. In this event, the cylindrical body is formed by connecting the first lateral side with the second lateral side. The loop portion may be formed on one surface of the flexible insulator film member in the vicinity of the upper side. The one end of the vertical feeding portion may lie on the lower side.

DESCRIPTION OF THE PREFERRED EMBODIMENT

Referring to FIGS. 1A, 1B, 2, and 3, the description will proceed to a four-point feeding loop antenna 10 according to an embodiment of this invention. The illustrated four-point feeding loop antenna 10 has a central axis O and comprises a cylindrical body 11, a loop portion 12, four feeders 13.

The cylindrical body 11 is formed by rounding a flexible insulator film member (which will later be described) around the central axis O in a cylindrical fashion in the manner which will later be described. The loop portion 12 is made of conductor and is formed on the cylindrical body 11 along a peripheral surface thereof around the central axis O in a loop fashion. The four feeders 13 are formed on the peripheral surface of the cylindrical body 11 to feed to the loop portion 12 at four points. As the conductor of the loop portion 12, for example, copper foil is used. In addition, the flexible insulator film member for use in the cylindrical body 11, for example, plastic such as polyimide resin is used. In the example being illustrated, the cylindrical body 11 ha a diameter of 20 mm.

Figure 1A:
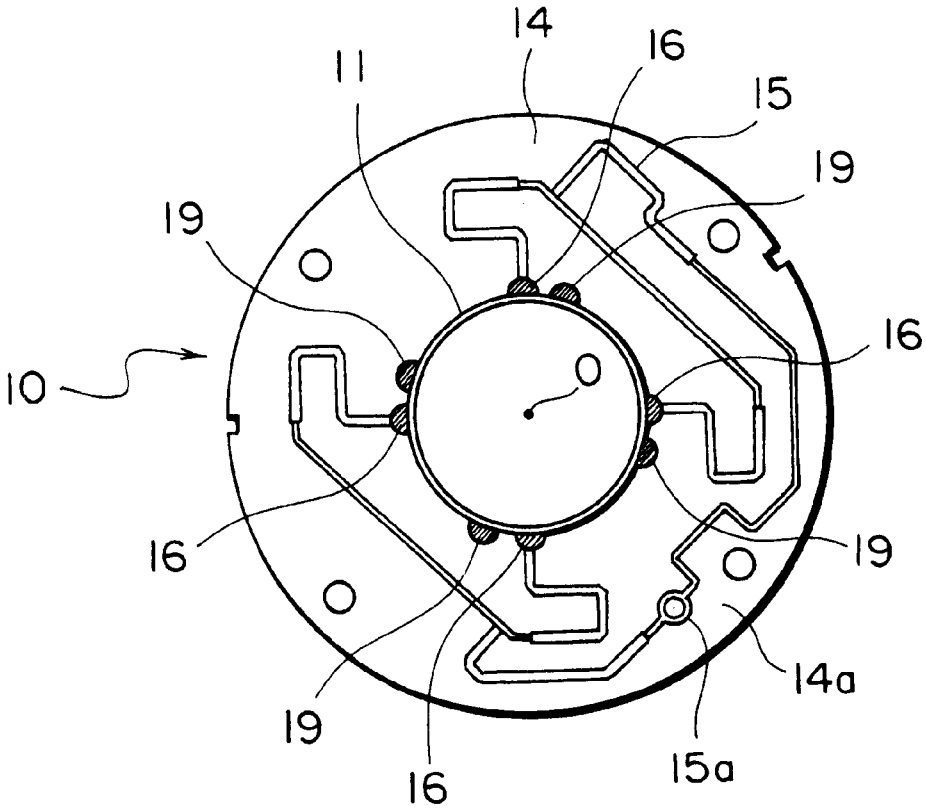
FIG. 1A is a plan view showing a four-point feeding loop antenna according to an embodiment of this invention.
Figure 1B:
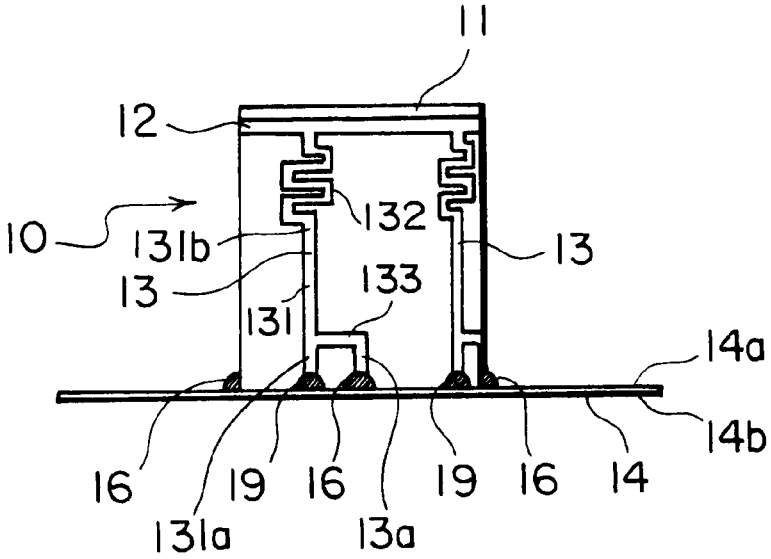
FIG. 1B is a front view of the four-point feeding loop antenna illustrated in FIG. 1A.

As shown in FIGS. 1A and 1B, the cylindrical body 11 has a longitudinal lower end which is fixed on a circuit board 14. The circuit board 14 has a main surface 14*a* on which a phase shifter 15 is formed. The circuit board 14 has a back surface 14*b* on which a ground conductive pattern (not shown) is formed. In addition, the four feeders 13 have four feeding terminals 13*a* which are electrically and mechanically connected to input terminals of the phase shifter 15 by means of solder 16.

Figure 2:
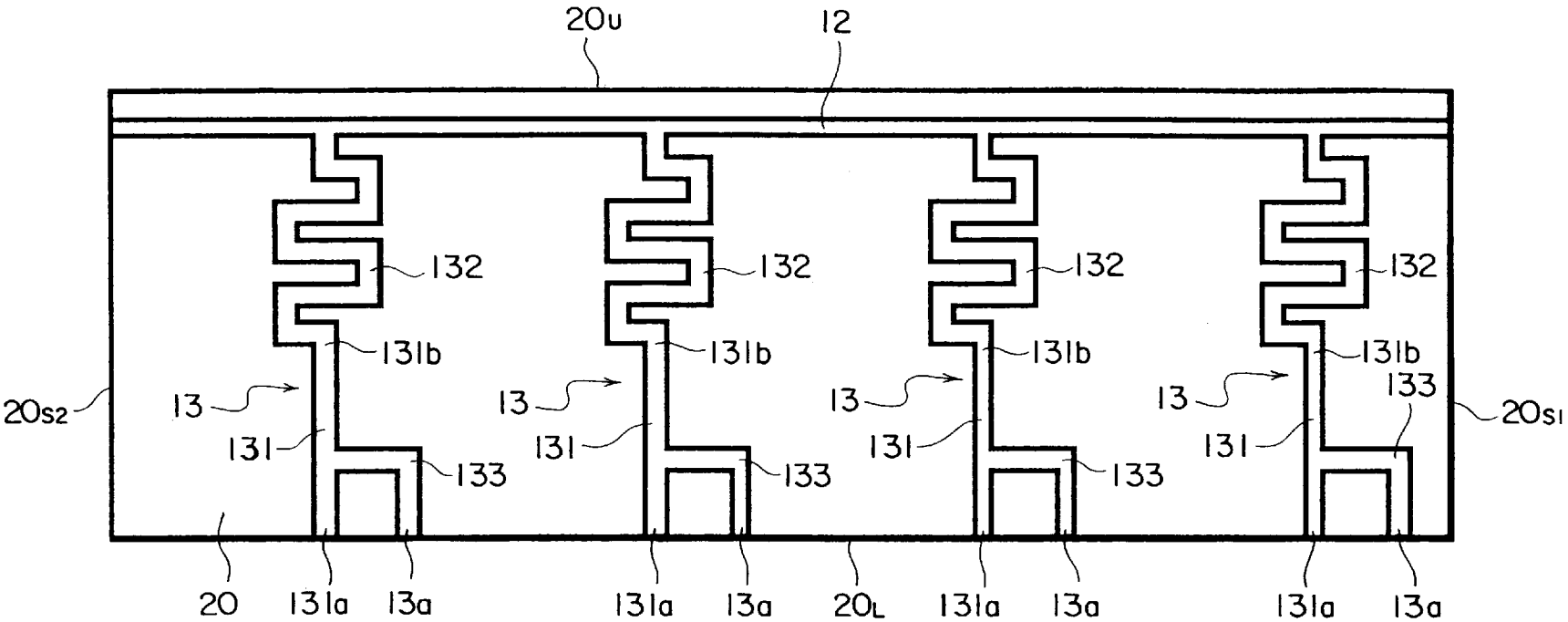
FIG. 2 is development of the four-point feeding loop antenna illustrated in FIGS. 1A and 1B.

Referring to FIG. 2, the flexible insulator film member 20 for use in forming the cylindrical body 11 substantially has a rectangular shape which has an upper side $\mathbf{20}_U$, a lower side $\mathbf{20}_L$, a first lateral side $\mathbf{20}_{S1}$, and a second lateral side $\mathbf{20}_{S2}$. By connecting the first lateral side $\mathbf{20}_{S1}$ with the second lateral side $\mathbf{20}_{S2}$, the cylindrical body 11 is formed as shown in FIGS. 1A and 1B. This connection between the first lateral side $\mathbf{20}_{S1}$ and the second lateral side $\mathbf{20}_{S2}$ is carried out, for example, by using double-sided adhesive tape or an adhesive agent.

In addition, the loop portion 12 is formed on one surface of the flexible insulator film member 20 in the vicinity of the upper side $\mathbf{20}_U$. While the cylindrical body 11 is formed by rounding the flexible insulator film member 20, both ends of the loop portion 12 are electrically connected to each other.

In the example being illustrated, each of the four feeders 13 comprises a vertical feeding portion 131, a zigzag line 132, and a tap 133. The vertical feeding portion 131 has one end 131*a* which is grounded and another end 131*b* which extends toward the loop portion 12. The zigzag line 132 is disposed between the other end 131*b* of the vertical feeding portion 131 and the loop portion 12. The tap 133 is for feeding from the feeding terminal 13*a* to the vertical feeding portion 131. As shown in FIG. 2, the one end 131*a* of the vertical feeding portion 131 lies on the lower side 20L of the flexible insulator film member 20.

In addition, formed on one surface of the flexible insulator film member 20, the loop portion 12 and the four feeders 13 may be made the same conductive material (e.g. copper foil).

Figure 3:
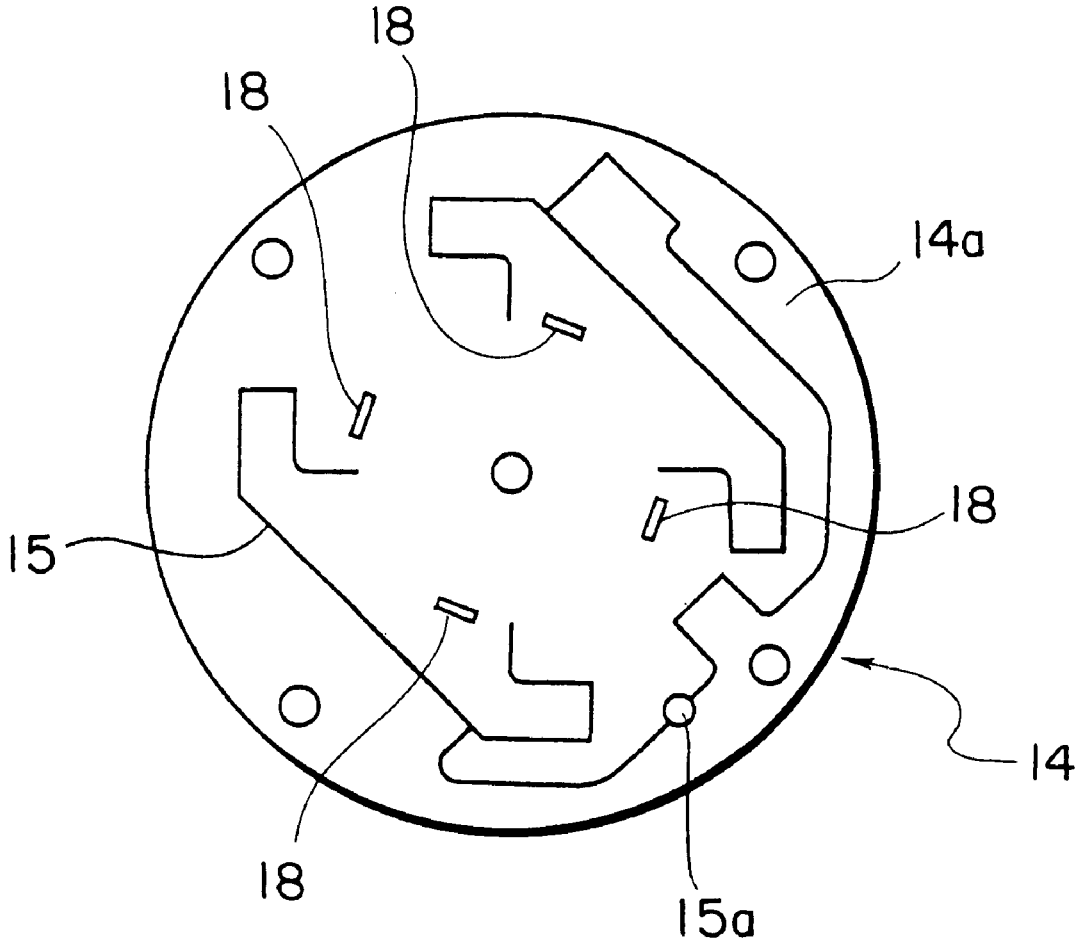
FIG. 3 is a plan view showing a circuit board for use in the four-point feeding loop antenna illustrated in FIGS. 1A and 1B.

As shown in FIG. 3, the circuit board 14 has four through holes 18 at positions which correspond to the respective ends 131*a* of the vertical feeding portion 131. The ends 131*a* of the vertical feeding portion 131 are electrically connected through the through holes 18 to the ground conductive pattern formed on the back surface 14*b* of the circuit board 14 by means of solder 19. As a result, the ends 131*a* of the vertical feeding portion 131 are grounded.

With this structure, by providing the feeder 13 with the zigzag line 132, the vertical feeding portion 131 is added with an inductance component and it results in compensating a reactance component of the feeder 13. In addition, by feeding through the tap 133, it is possible to obtain an impedance match of the feeder 13 by adjusting a height of the tap 133. When the height of the tap 133 increases, the impedance becomes higher. When the height of the tap 133 decreases, the impedance becomes lower. In other words, by providing the feeder 13 with the zigzag line 132, it is possible to make the impedance at the feeding terminal 13*a* a pure resistance and it is possible to easily obtain the impedance match due to the tap 133. Accordingly, it is unnecessary to provide the four-point feeding loop antenna 10 with a special matching circuit which is required in the conventional four-point feeding loop antenna.

In general, in the four-point feeding loop antenna, it is necessary to make the feeding impedance 50Ω. In the four-point feeding loop antenna 10 according to the embodiment of this invention, it is possible to lower an impedance at each feeding terminal 13*a* because the feeder 13 comprises the zigzag line 132 and the tap 133 as well as the vertical feeding portion 131. It is therefore possible to make an impedance at an output terminal 15*a* of the phase shifter 15 50Ω.

On the contrary, a conventional four-point feeding loop antenna has a too high impedance at each feeding terminal 13*a* because the conventional four-point feeding loop antenna comprises feeders each of which consists of a vertical feeding portion alone but not includes a zigzag line and a tap. Thus, in the conventional four-point feeding loop antenna, a special matching circuit for obtaining an impedance match at an output terminal 15*a* of the phase shifter 15 is required aside from the four-point loop antenna, as mentioned in the preamble of the instant specification.

While this invention has thus far been described in conjunction with a preferred embodiment thereof, it will now be readily possible for those skilled in the art to put this invention into various other manners. For example, although the feeders 13 substantially extend in a normal direction to the lower side $\mathbf{20}_L$ of the flexible insulator film member 20 in the above-mentioned embodiment, they may substantially extend in an oblique direction to the lower side $\mathbf{20}_L$ of the flexible insulator film member 20. In addition, although the taps 133 are formed on the flexible insulator film member 20 in the above-mentioned embodiment, they may formed as special separated lines independent of the flexible insulator film member.

What is claimed is:

1. A four-point feeding loop antenna comprising:

a cylindrical body formed by rounding a flexible insulator film member around a central axis in a cylindrical fashion, said cylindrical body having a peripheral surface;

a loop portion made of conductor, said loop portion being formed on said cylindrical body along said peripheral surface around said central axis in a loop fashion; and four feeders formed on the peripheral surface of said cylindrical body to feed to said loop portion to four points, each of said four feeders comprising a vertical feeding portion having one end grounded and another end extending toward said loop portion, a zigzag line disposed between the other end of said vertical feeding portion and said loop portion, a tap for feeding from a feeding terminal to said vertical feeding portion.

2. A four-point feeding loop antenna as claimed in claim 1, wherein said flexible insulator film member substantially has a rectangular shape having an upper side, a lower side, a first lateral side, and a second lateral side, said cylindrical body being formed by connecting said first lateral side with said second lateral side, said loop portion being formed on one surface of said flexible insulator film member in the vicinity of the upper side, and said one end of said vertical feeding portion lying on said lower side.

* * * * *